United States Patent [19]

Freisinger et al.

[11] Patent Number: 4,732,405

[45] Date of Patent: Mar. 22, 1988

[54] SAFETY SKI BINDING

[75] Inventors: Henry Freisinger, Vienna; Franz Luschnig, Traiskirchen; Karl Stritzl; Johann Zotter, both of Vienna, all of Austria

[73] Assignee: TMC Corporation, Baar, Switzerland

[21] Appl. No.: 738,159

[22] Filed: May 24, 1985

[30] Foreign Application Priority Data

May 25, 1984 [AT] Austria ..... 1750/84

[51] Int. Cl.[4] ..... A63C 9/081

[52] U.S. Cl. ..... 280/634; 280/613; 280/617; 280/618; 280/628; 280/631

[58] Field of Search ..... 280/634, 618, 617, 613, 280/628, 631, 632

[56] References Cited

U.S. PATENT DOCUMENTS

| | | | |
|---|---|---|---|
| 3,580,597 | 5/1971 | Beyl | 280/631 |
| 3,931,982 | 1/1976 | Kubelka | 280/613 |
| 3,955,825 | 5/1976 | Kubelka et al. | 280/618 |
| 3,957,280 | 5/1976 | Turnheim et al. | 280/613 |
| 4,070,034 | 1/1978 | Swenson | 280/631 |
| 4,113,276 | 9/1978 | Kirsch | 280/618 |
| 4,188,045 | 2/1980 | Marker | 280/618 |
| 4,226,439 | 10/1980 | Kirsch | 280/628 |
| 4,394,032 | 7/1983 | Storandt et al. | 280/618 |
| 4,415,176 | 11/1983 | Hull et al. | 280/612 |
| 4,484,764 | 11/1984 | Kirsch | 280/618 |

FOREIGN PATENT DOCUMENTS

| | | | |
|---|---|---|---|
| 207506 | 3/1909 | Fed. Rep. of Germany | 280/618 |

*Primary Examiner*—John J. Love
*Assistant Examiner*—Eric Culbreth
*Attorney, Agent, or Firm*—Flynn, Thiel, Boutell & Tanis

[57] ABSTRACT

A ski binding includes a base plate adapted to be secured to a ski, a cover plate supported on the base plate for pivotal movement about a vertical axis, and an adjustable release arrangement for yieldably resisting pivotal movement of the cover plate in either direction away from an initial position. The release arrangement can be adjusted from a side of the binding. Front and rear holding mechanisms are provided on the cover plate and releasaly hold a ski shoe on the cover plate, the front holding mechanism including a pivotally supported holding jaw which is controlled by the adjustable release arrangement, and the rear holding mechanism being adapted to release only in response to an upward force component.

15 Claims, 5 Drawing Figures

SAFETY SKI BINDING

FIELD OF THE INVENTION

This invention relates to a safety ski binding and, more specifically, to a binding having connecting devices for downhill or cross-country skiing shoes which preferably have gripping soles of rubber, the connecting devices including at least one rear and one front holding member which are spaced a constant distance from one another for all shoe sizes and thus effect a torque transmission from the shoe to the ski which is moment-balanced for all shoe sizes about a vertical axis arranged in the tibia region and formed for example by a bolt which supports a cover plate which can be swivelled against the force of a spring, the binding having at least one initial-tensioning mechanism for adjusting the force of the spring.

BACKGROUND OF THE INVENTION

Ski bindings of the foregoing type are called mid-point bindings and have specific advantages over bindings with a jaw-heel system. Among other advantages, the friction during a horizontal release is substantially reduced, since the plate on its ski-fixed axle of rotation must overcome a substantially smaller friction than is the case with a shoe which is clamped between a heel holder and a front jaw and which must slide on the upper side of the ski. Furthermore, variations in shoe size do not have an adverse effect on the release, because the distance between the front and rear holding members and the pivot point is the same in each case, wherein standardized shoe soles or plates secured on the shoe soles are secured to the front and rear holding members.

The control during a horizontal release is typically accomplished in mid-point binding systems by a mechanism which is responsive to the degree of swivelling of the cover plate relative to the ski or to the torque caused by this swivelling and which forwards this information to the heel holder, the heel holder releasing at a specific horizontal torque and also when a specific vertical force occurs.

This type of release functions advantageously so long as a vertical force exists. If, however, due to a special fall, a vertical force does not exist, it can happen that the binding, despite a dangerous horizontal force, does not release the shoe and thus does not prevent the danger of injury to the skier.

A purpose of the invention is to provide a ski binding of the abovementioned type which, during an overload, releases satisfactorily both vertically and also horizontally, wherein for the horizontal release no vertical forces whatsoever are necessary.

SUMMARY OF THE INVENTION

This purpose is attained according to the invention by the front holding member being a snap-off mechanism with a holding jaw which engages the shoe and is controlled by a controlling mechanism responsive to the swivelling moment of the cover plate against the force of the spring. The initial-tensioning mechanism has an operating member, preferably a screwhead which can be operated from laterally of the ski, and the rear holding member is designed as a heel holder which reacts only to vertical forces.

Through this, it now becomes possible for the first time to release a ski binding with a plate supported rotatably about a ski-fixed axis of rotation in response to both vertical and horizontal forces, without any need for a vertical force during a horizontal release.

According to a development of the invention, the controlling mechanism has a slide member which is biased by a spring and has a cam engaged by a roller, through which in an advantageous manner the elongated type of construction of a plate binding is utilized.

A further development of the invention is characterized by the jaw and the heel holder having gripping members which engage corresponding gripping depressions in the ski shoe, the gripping depressions tapering toward the inside. The appearance of the shoe is only slightly influenced by the gripping depressions and still dependable force transmission is assured, wherein through the widening of the gripping depressions toward the outside plugging thereof, for example by snow or ice, is avoided.

According to a further special development of the invention, the holding jaw has two inclined surfaces which lie in planes which extend substantially normal to the upper side of the cover plate and which define with one another an angle in the range of 30°–100°, preferably approximately 80°, the intersection of the planes, viewed in a skiing direction, lying in front of the holding jaw and the sole of the ski shoe having portions which cooperate with the inclined surfaces. The inclined surfaces effect in an advantageous manner a conversion of horizontal forces which act onto the jaws into forward forces. The associated surfaces on the shoe sole reinforce this effect. If the holding jaw (and preferably the entire holding member) is, according to a further development of the invention, pivotal about a transverse axle supported on the cover plate, wherein in the swivelled position the holding jaw lies below the plate, then in response to a torsion force which is associated with a thrust in the longitudinal direction of the ski, the holding jaw is swung below the plate, which causes the shoe during the jaw-release operation to be released not only laterally but also forwardly from the binding.

For a reliable return to a position ready for the stepping in, it is provided according to a further special development of the invention that the holding jaw or the holding member is biased toward its active position by at least one spring, for example a torsion spring, the holding jaw or holding member being held in its active position by a nose on a support of the ski-fixed base plate and the dimension of such support in a direction transversely of the ski determining the elasticity range of the binding for a horizontal release.

According to another development of the invention, the gripping depressions are set back from the front and rear ends of the sole of the ski shoe so that, in the clamped-in condition of the shoe, its ends project at least partially over the front holding member and the heel holder, the underside of at least the front end of the sole starting at approximately the same plane as the underside of the sole of the shoe and extending upwardly at an acute angle of approximately up to 15°. This design gives the shoe a very safe behavior for walking. With this, walking is much easier, particularly on difficult surfaces such as stairs, and the stepping-in safety of the user is substantially increased, through which the falls which to date often occurred with shoes can be avoided.

According to another development of the invention, the cam is constructed as the edge of a recess in the slide member, the slide member being constructed as a flat piece and the recess also receiving the pressure end of the spring, the pressure end of the spring being supported on an edge of the recess opposite from the cam. This flat design of the slide member permits on the one hand a low physical binding height to meet the demand for, as much as possible, a small distance between the upper side of the ski and the ball of the skier's foot, and on the other hand permits the slide member to be manufactured easily and the entire measuring and controlling mechanism to be substantially disposed within the base plate.

In order to reliably assure consistency in successive releases, it is furthermore inventively provided that the slide member is longitudinally guided by guide elements arranged on the base plate or cover plate, which guide elements can be grooves in which outer edges of the slide member slide or, according to another development of the invention, can be rollers supported on vertical axles. The advantage of this modification is that only a small amount of friction exists in the measuring and controlling mechanism during a measuring or releasing operation.

A further development of the invention is characterized by the initial-tensioning mechanism longitudinally movably supporting a bearing end of the spring, preferably by means of a spring washer. The spring washer is advantageously arranged within the recess, which also permits the spring to be optimally disposed within the slide member.

According to another embodiment of the invention, the initial-tensioning mechanism includes at least one toggle lever which is supported on a vertical bearing axle secured on the base plate, one arm of the toggle lever being engaged by a screw adjusting device and the other arm thereof supporting the spring washer and being biased by the spring. This development permits an adjustment in a simple manner and avoids the situation in which the initial-tensioning mechanism is accessible only in the longitudinal direction of the ski which, in the case of a plate binding, is complicated because of the relatively large over-all length.

For a tilt-free function of the initial-tensioning mechanism, it can include two toggle levers which are maintained parallel and at a constant distance from one another by the spring washer and by an engaging part for the screw. Without any unnecessary material use, the function of the adjustment is reliably assured through this and the spring washer is guided in an optimum manner, through which possible deflections during the skiing operation are also prevented.

The heel holder has, according to a special development of the invention, a two-arm sole down-holding member, one arm of which has gripping members which are in engagement with the gripping depressions and are simultaneously engaged by the shoe, while the second arm serves as a release lever which has an extension extending in a direction approximately opposite the release lever, the free end of the extension being a controlling cam which cooperates with a locking part, for example a locking roller, biased by at least one second spring and pressed against a locking surface. This inventive heel holder is distinguished by a small size and by excellent operating safety. It is inventively further provided that the locking roller is supported on a draw rod which, through an adjusting mechanism, is coupled to the pressure end of the second spring.

BRIEF DESCRIPTION OF THE DRAWINGS

The invention will be described in greater detail in connection with the drawings, which illustrate one exemplary embodiment. In the drawings.

DETAILED DESCRIPTION

Figure 1:
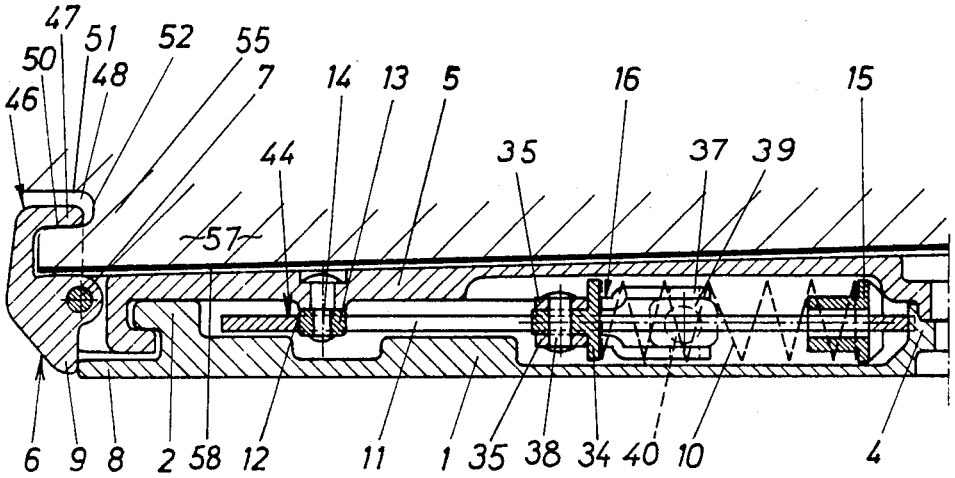
FIG. 1 is a fragmentary sectional side view of a front portion of a ski shoe and binding embodying the present invention.
Figure 2:
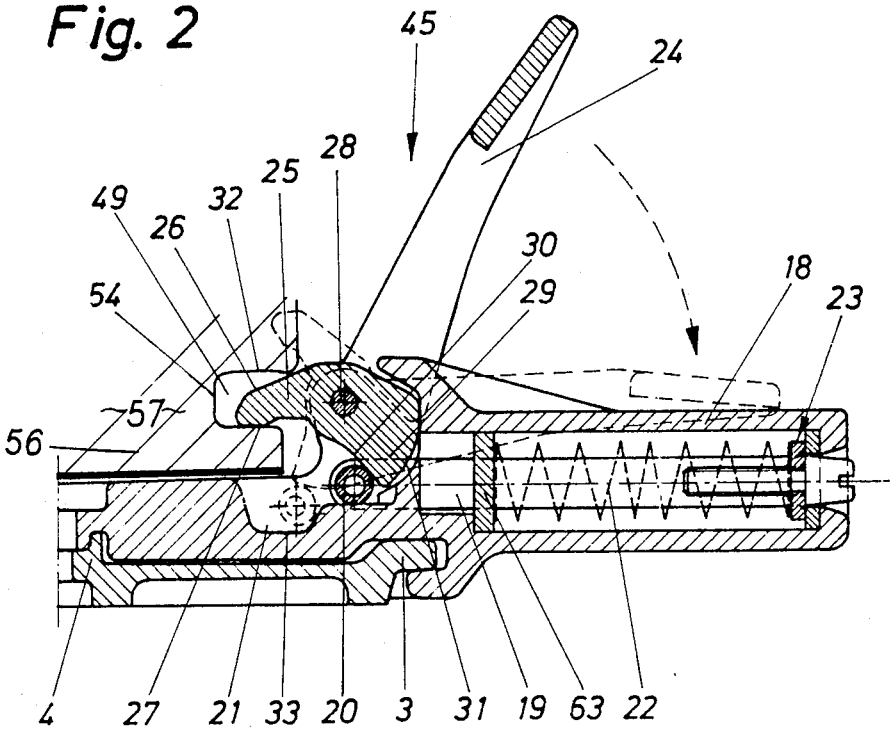
FIG. 2 is a fragmentary sectional side view of a rear portion of the ski shoe and binding of FIG. 1.

As can be seen in FIGS. 1 and 2, a preferred embodiment of the ski binding includes a base plate 1 which is mountable on the upper side of a ski and which has in its front and rear regions respective portions 2 and 3 which are each undercut and serve the clearance-free guiding of a cover plate 5 supported for rotation about a vertical axle portion 4. The vertical axle 4 is formed by a pot-shaped recess in a raised portion of the base plate 1, which pot-shaped recess is engaged by a corresponding downward projection on the plate 5. The plate 5 carries at its front end a transverse axle 7 which pivotally supports a swingable holding member 6. The holding member 6 has a holding jaw 46 which projects over the upper side of the plate 5 and has a nose 9 which engages a support portion 8 of the base plate 1. The holding jaw 46 has two spaced gripping members 47 which engage gripping recesses or depressions 48 in the sole 57 of the ski shoe 17, and in this manner hold the shoe in the binding. The gripping depressions 48 have holding surfaces 50 which directly engage the gripping members 47, and surfaces 51 and front surfaces 52 which lie opposite the gripping members.

Figure 1A:
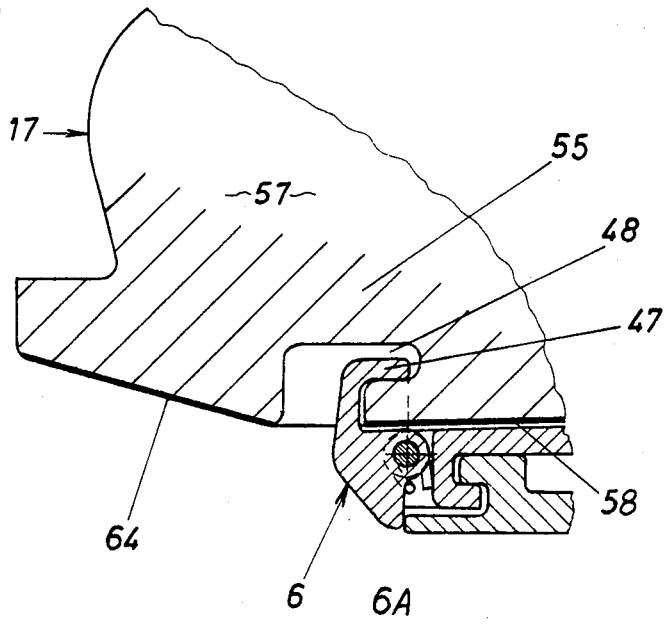
FIG. 1*a* is a fragmentary sectional side view of the front end of the ski shoe and binding of FIG. 1.

The ski shoe 17 has on its underside a gripping sole 58. Similar to the front region 55 of the sole 57, there are two gripping recesses or depressions 49 in the rear region 56 of the sole 57 of the shoe 17, which gripping depressions 49 are each defined by a holding surface 27, a front surface 54 and a stepping-in surface 32 which lies opposite the holding surface 27. The front end region 55 of the sole 57 of the shoe 17 and the rear end region 56 of the sole 57 each project at least a small distance beyond the respective gripping depressions 48 and 49. The underside of the end regions 55 and 56 can also be guided downwardly approximately to the level of the sole 58, as is illustrated at 64 in FIG. 1*a*. The underside 64 is inclined upwardly at an angle of approximately 15°. The gripping depressions 48 and 49 are designed to enlarge outwardly and their front surfaces 52 and 54 are, when the ski shoe is inserted, spaced from the gripping members 47 and 25, through which a plugging up of the depressions 48 and 49 by ice or snow is avoided.

A sole down-holding member which is fork-shaped in a top view has two spaced gripping members 25 which engage the rear gripping depressions 49 of the shoe 17. The sole down-holding member is integral with a release lever 24 and an extension or cam 29, and is supported pivotally on the base plate by a transverse axle 28. The stepping-in surface 32 is, as already mentioned, placed opposite the holding surface 27 of each gripping depression 49. During a stepping in, the stepping-in surface 32 engages the upper side of the gripping member 25, which upper side is constructed as a stepping surface 26, and moves the gripping member 25 into the holding position. The open position of the sole down-holding member is illustrated by dashed lines in FIG. 2.

Figure 3:
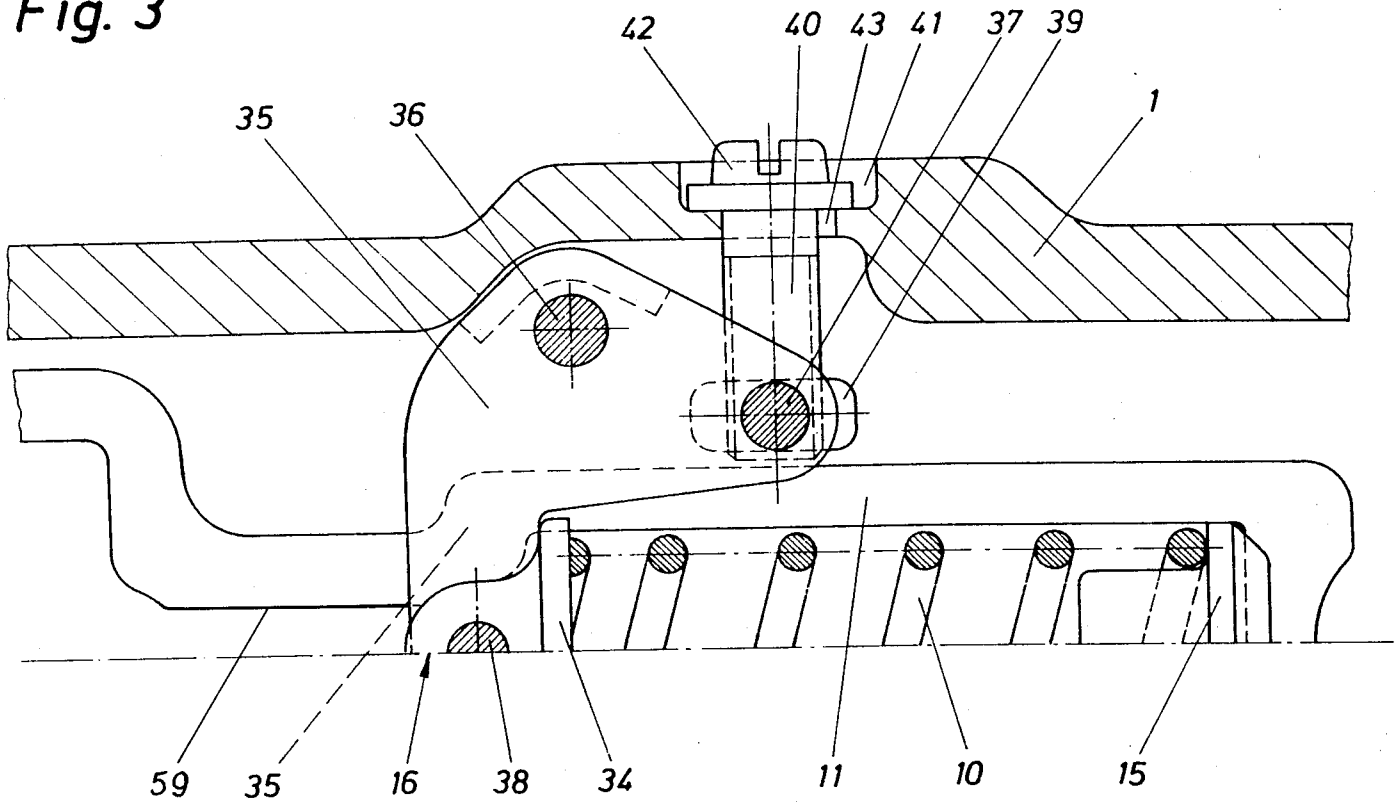
FIG. 3 is a fragmentary sectional top view of an initial-tensioning mechanism of the binding of FIG. 1.
Figure 4:
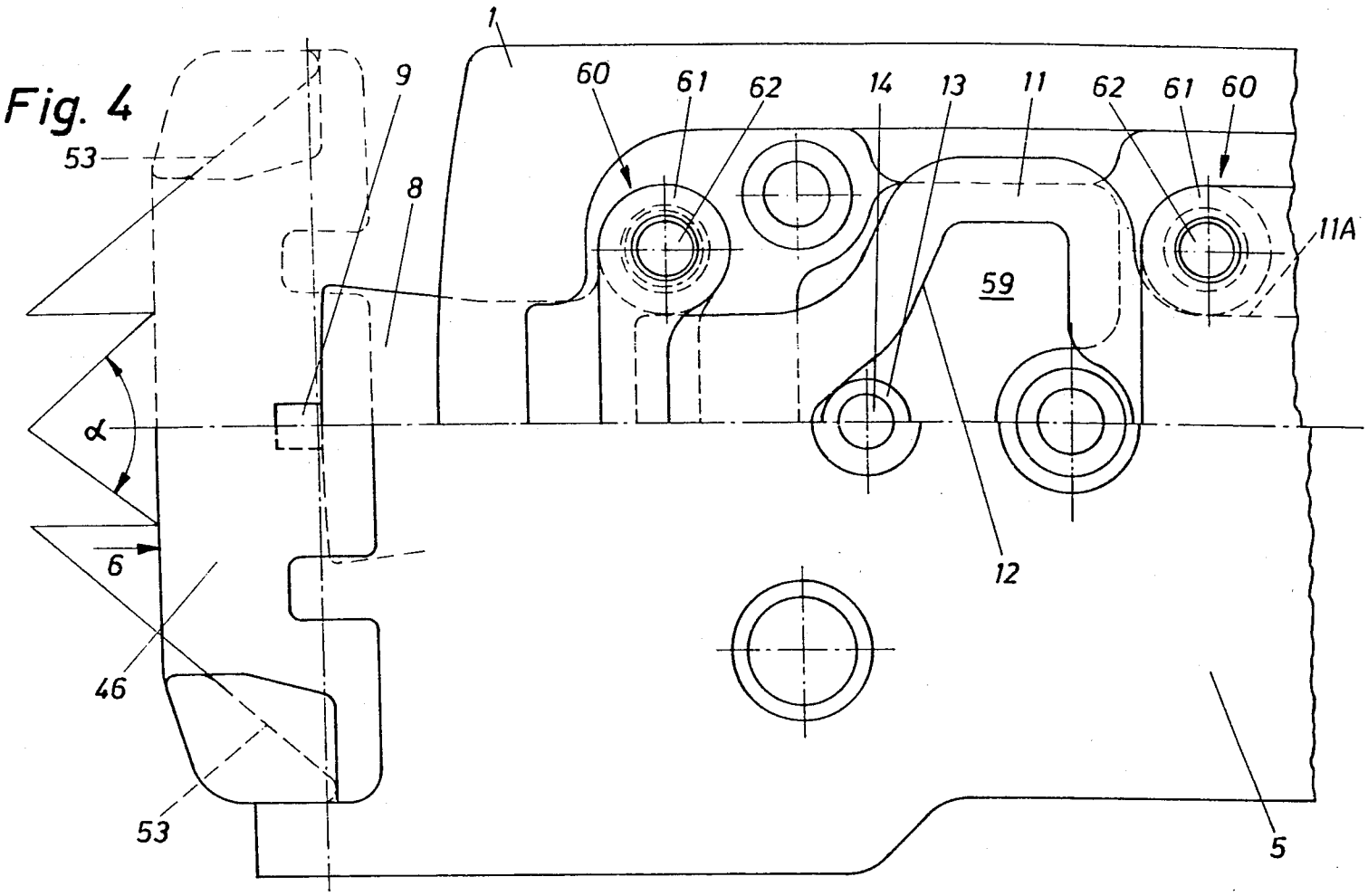
FIG. 4 is a top view of the front of the binding of FIG. 1 with the cover plate thereof partially cut away so as to show a cam mechanism therebelow.

The torque created during a horizontal swinging out of the plate 5 about the vertical axle 4 acts on a controlling mechanism 44 (FIGS. 3 and 4). The controlling mechanism 44 includes a flat slide member 11 which is movable longitudinally of the base plate and has a recess 59, an edge of the recess 59 being constructed as a cam 12 which is engaged by a roller 13 rotatably supported on a vertical bolt 14 secured to the cover plate (FIG. 1). At the opposite end of the recess 59, the slide member 11 receives a pressure element or abutment 15 which supports an end of a spiral spring 10. The spiral spring 10 is tensioned at its end opposite to the pressure element 15, which end is also provided within the recess 59 of the slide member 11, by an initial-tensioning mechanism 16 which will be discussed in detail later.

As can be seen from FIG. 4, the slide member 11 is guided laterally by guide elements 60, which are rollers 61 supported rotatably on vertical axles 62 secured to the base plate. During swivelling of the cover plate 5 relative to the base plate 1, the roller 13 rolls along the cam 12, which causes the slide member 11 to be urged in a forwardly inclined direction. The slide member 11 is, however, forced to move directly forwardly in the longitudinal direction of the ski by the guide elements 60. Through this forward movement, the pressure element 15 is moved forwardly and causes the spring 10 to be further compressed. By suitably designing the curve 12, any desired control of the swivelling movement is possible, wherein commonly the force resisting swivelling increases with an increasing swinging out.

The guide elements 60 could alternatively be integral parts of the base plate 1 which have in inwardly facing vertical surfaces thereof longitudinally extending guide grooves (not illustrated) which each slidably receive a side edge 11A of the slide member 11.

The holding-jaw release occurs at a specific angle of swivelling, which is defined by the support 8. In particular, the nose 9 of the front holding member 6 slides along the support 8 during swivelling of the plate 5 until it has reached the end of the support 8, and it then pivots about the plate-fixed swivel axle 7 forwardly to a position below the upper side of the plate 5. This movement is assisted by inclined surfaces 53 (FIG. 4) which are provided on the inner side of the holding jaw 46, face the ski shoe 17, extend approximately perpendicular to the upper side of the plate 5, and define an angle $\alpha$ with each other of between 30° and 100°.

The ski shoe 17 has inclined surfaces which cooperate with the inclined surfaces 53 of the holding jaw 46 by engaging them due to the torsion of the ski shoe relative to the binding. Through this, the lateral force exerted by the ski shoe on the holding member 6 through the holding jaw 46 is converted into a forward force which causes the holding jaw 46 to be pressed forwardly. As soon as the support nose 9 leaves the support 8, the jaw 46 swivels forwardly. This swivelling may be assisted by a forward thrust exerted by the shoe 17 in the longitudinal direction of the ski. The initial tension of the spring 10 and thus the swivelling force which leads to the release is, as can be seen in FIGS. 1 and 3, adjusted by the initial tensioning mechanism 16. The initial-tensioning mechanism 16 includes two congruent toggle levers 35 which are arranged one above the other and are each supported pivotally on a vertical bearing axle 36 secured to the base plate. The toggle levers 35 have arms which support a vertical axle 38, and a spring washer or abutment 34 for the spring 10 is supported on the swivel axle 38. The other arms of the toggle levers 35 support a further swivel axle 37 which in turn supports an engaging part 39 which is a thread-carrying nut for a screw 40. The screw 40 is rotatably supported in a recess 43 of the base plate 1 and carries a screwhead 42, which can be operated from laterally of the plate 1 by means of a screw driver. The screw head 42 is, in order to be protected as much as possible, partly disposed in a countersunk portion 41 in the plate 1. When the screw 40 is rotated, the axial position of the engaging part 39 on the screw 40 changes, which causes the swivel axis 37 to be moved in one or the other direction. Through this, the arms of the toggle levers 35 are moved, which causes their other arms to press the spring washer 34 against the spring 10 or to yield in the direction of the spring tension. The pivot point of the individual toggle levers 35 is in each case defined by the bearing axle 36.

The heel holder 45, in the top view, includes the approximately fork-shaped sole down-holding member which has thereon the gripping members 25, the release lever 24 and the cam 29, the cam 29 engaging a locking roller 20 by means of a sliding surface 30 thereon. The locking roller 20 is rotatably supported on one end of a draw rod 19 which is biased at its opposite end by a further spring 22 through a conventional spring tension adjusting mechanism 23. When the sliding surface 30 moves the locking roller 20 forwardly along a locking surface 33, the spring 22, which has its opposite end supported against an abutment 63 secured to the base plate, is tensioned. The locking surface 33 is designed so that it has a locking pan 21 into which the locking roller 20 moves after it has moved the rod 19 a predetermined distance, which permits the locking roller 20 to be engaged by the second side 31 of the cam 29 and to thus be held in the locking pan 21. This position of the locking roller 20 is illustrated by dashed lines. Only during a reentry of the ski shoe into the binding or during a closing of the heel holder 45 by hand is the locking roller 20 pulled back into its initial position by the force of the spring 22. The housing 18 for the spring 22 is integral with the plate 5.

The release operation and the reentry (stepping-in) are described briefly hereinafter.

When a torsional force acts on the leg of the skier, the torque is transmitted through the ski shoe 17 or through its sole 57 to the front and rear connecting devices, or in other words onto the front jaw 46 and the sole down-holding member and in particular onto the gripping members 47 and 25. Consequently, the plate 5 rotates about its vertical axle 4. Through this, the roller 13 is moved along the cam 12 of the slide member 11 and the slide member 11, guided by the guide elements 60, is moved forwardly toward the tip of the ski. The spring 10 is thus compressed and yieldably resists the swivelling movement. If the swivelling movement exceeds the resistance force of the spring 10, which force is adjusted by means of the initial-tensioning mechanism 16, then the nose 9 of the front jaw 46 slides along the edge of the base-plate-fixed support 8. Through the inclined surfaces 53 and the correspondingly constructed surfaces on the ski shoe 17, the torsion force is converted into a forward force and, when the nose 9 has moved beyond the end of the support 8, the jaw 46 of the front holding mechanism pivots forwardly about the axis 7 and through this releases the shoe. A torsion spring 6A (FIG. 1*a*) then swings the front holding member 6 back into the holding position and the spring 10 pulls the plate 5, through the force of the cam 12 acting onto the roller 13, back into the downhill skiing position.

A vertical release is caused by a torque or force acting on the shoe 17 in a vertical direction in a manner so that the holding surfaces 27 of the gripping depressions 49 press the gripping members 25 upwardly, which causes the release lever 24 and the nose 29 to pivot about the common axle 28. The cam 29 engages with its sliding surface 30 the locking roller 20 until it snaps into the locking pan 21. Then, the tip of the cam 29 slides over the locking roller 20 and the pressure surface 31 of the cam 29 comes into contact with the locking roller 20 and through this holds it in the locking pan 21. The spring 22, which has its own spring-force adjustment mechanism 23, is further compressed by the associated movement of the draw rod 19, which carries the locking roller 20. Reentry, or in other words stepping-in, then occurs through the stepping surfaces 26 of the gripping members 25 being engaged by the stepping-in surfaces 32 of the sole 57 of the shoe 17.

Instead of the shoe sole 57 being provided with the gripping depressions 48 and 49, it would also be possible to use a separate detachable sole plate having the same gripping depressions.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a safety ski binding having connecting means for downhill or cross-country ski shoes having gripping soles made of rubber, said connecting means including at least one rear and one front holding member which have a constant distance from each other for all shoe sizes and thus provide a torque transmission from the ski shoe to the ski which is moment-balanced for all shoe sizes about a vertical axle arranged on the ski in the tibia area, said vertical axle pivotally supporting a cover plate swivelled against the force of a spring provided on said ski, and at least one initial-tensioning means for adjusting the force of said spring, the improvement comprising wherein said front holding member includes a holding jaw and a snap-off means for holding said holding jaw in engagement with the ski shoe, said holding jaw being movable between a ski shoe holding position and a ski shoe releasing position and a controlling means for controlling the swivelling moment of said cover plate against the force of said spring, wherein said initial-tensioning means has an operating member operable laterally of the ski, wherein said rear holding member is a heel holder having means for allowing said rear holding member to react only to vertical forces, wherein said controlling means includes a slide member having a recess therein, wherein guide means is provided for guiding said slide member for movement relative to said ski, wherein a roller means is provided on said cover plate and engages an edge surface of said recess so that a pivotal movement of said cover plate will cause said roller means to effect a movement of said slide member and, consequently, said cover plate against the urging of said spring.

2. The binding according to claim 1, wherein said holding jaw and said heel holder have gripping members which engage corresponding gripping depressions in the ski shoe.

3. The binding according to claim 2, wherein said gripping depressions are set back from the front and rear ends of the sole of the ski shoe so that, in a clamped-in condition of the shoe, the end regions project at least partially beyond said front holding member and said heel holder, and wherein the underside of at least the front region of the sole starts at approximately the same plane as the underside of the shoe and is inclined upwardly at an acute angle of up to approximately 15°.

4. The binding according to claim 1, wherein said holding jaw has two inclined surfaces which lie in planes which extend substantially normal to the upper side of said cover plate and define an angle in the range of 30° to 100° with respect to one another, the intersection of the planes, viewed in a skiing direction, lying in front of said holding jaw.

5. The binding according to claim 1, wherein said holding jaw is pivotal about a transverse axle which is supported on said cover plate, wherein in said ski shoe releasing position, said holding jaw lies below the upper side of said cover plate.

6. The binding according to claim 1, wherein a resilient means is provided for continually urging said holding jaw toward said ski shoe position, wherein said snap-off means includes said holding jaw being held in said ski shoe holding position by a nose on a support on a ski-fixed base, and wherein the dimension of said support in a direction transverse to the longitudinal direction of the ski determines a range over which the binding is elastically yieldable.

7. The binding according to claim 1, wherein said slide member has a further recess therein receiving a pressure element of said spring, said pressure element being supported on an edge of said further recess remote from said cam means.

8. The binding according to claim 1, wherein said guide means guides said slide member longitudinally of the ski.

9. The binding according to claim 8, wherein said guide means are rollers which are rotatably supported on vertical axles and between said slide member slides.

10. The binding according to claim 1, wherein said initial-tensioning means longitudinally movably supports a bearing end of said spring.

11. The binding according to claim 10, wherein said bearing end of said spring is arranged within said recess in said slide member.

12. The binding according to claim 1, wherein said initial-tensioning means includes at least one two-arm toggle lever which is pivotally supported on a vertical bearing axle secured to said ski, one arm of said toggle lever being engaged by a screw adjusting means and an other arm engaging an end of said spring.

13. The binding according to claim 12, wherein said initial tensioning means includes two of said toggle levers which straddle said slide member.

14. The binding according to claim 2, wherein said heel holder has a two-arm sole down-holding member, one arm of which is a grippng means which engages said gripping depressions in said ski shoe, while a second arm is a release lever having an extension thereon, a free end of said extension having a cam surface thereon which cooperates with a locking roller biased by a further spring for urging said locking roller against a locking surface.

15. The binding according to claim 14, wherein said locking roller is supported on a draw rod which, through an adjusting means, is coupled to one end of said further spring.

* * * * *

UNITED STATES PATENT AND TRADEMARK OFFICE

CERTIFICATE OF CORRECTION

PATENT NO. : 4 732 405

DATED : March 22, 1988

INVENTOR(S) : Henry FREISINGER

It is certified that error appears in the above-identified patent and that said Letters Patent is hereby corrected as shown below:

Column 8, Line 30; Change "ski shoe position" to ---ski shoe holding position---.

Signed and Sealed this

Fourth Day of October, 1988

*Attest:*

DONALD J. QUIGG

*Attesting Officer*

*Commissioner of Patents and Trademarks*